US005940097A

United States Patent [19]

Imai

[11] Patent Number: 5,940,097

[45] Date of Patent: Aug. 17, 1999

[54] ARRANGEMENT FOR DETACHING A HEAD UNIT FROM A CARRIAGE IN AN INK JET PRINTER

[75] Inventor: Koji Imai, Nagoya, Japan

[73] Assignee: Brother Kogyo Kabushiki Kaisha, Nagoya, Japan

[21] Appl. No.: 08/823,185

[22] Filed: Mar. 24, 1997

[30] Foreign Application Priority Data

Mar. 22, 1996 [JP] Japan ..... 8-093241
Mar. 22, 1996 [JP] Japan ..... 8-093242

[51] Int. Cl.[6] ..... G08B 25/00; B41J 2/14

[52] U.S. Cl. ..... 347/49; 347/5; 347/50; 340/500; 340/525

[58] Field of Search ..... 347/49, 50, 5; 340/500, 525

[56] References Cited

U.S. PATENT DOCUMENTS 4,423,410 12/1983 Galvin et al. ..... 340/525
5,461,405 10/1995 Lehmann et al. ..... 347/49
5,530,465 6/1996 Hasegawa ..... 347/70
5,550,570 8/1996 Kurata et al. ..... 347/49

*Primary Examiner*—N. Le
*Assistant Examiner*—Lamson D. Nguyen
*Attorney, Agent, or Firm*—Pollock, Vande Sande & Amernick

[57] ABSTRACT

To allow a head unit to be detached from a carriage while preventing a driver IC substrate provided on the head unit from being damaged by a latchup current, electrical charges stored in a smoothing capacitor are discharged in a resistor and dissipated therein when, a power source cutoff signal changes from a high level to a low level. When the smoothing capacitor is discharged, an LED is turned off to indicate the completion of the discharge. Upon confirming that the LED has turned off, the head unit is detached from the carriage. In another solution, the head unit is locked to the carriage by a lock mechanism. A high voltage contact in a dimple FPC is disconnected from the driver IC substrate when a lever of the lock mechanism is rotated in counter-clockwise direction to unlock the head unit. In this condition, the head unit can be detached from the carriage without damaging the driver IC substrate.

16 Claims, 13 Drawing Sheets

ARRANGEMENT FOR DETACHING A HEAD UNIT FROM A CARRIAGE IN AN INK JET PRINTER

BACKGROUND OF THE INVENTION

1. Field of the Invention

The present invention relates to an ink jet printer for printing on a printing medium with ink droplets ejected from nozzles.

2. Description of the Related Art

FIG. 1 shows a conventional ink jet head which ejects ink droplets from nozzles utilizing displacements of piezoelectric elements. FIG. 2 shows a driving system of the head shown in FIG. 1. As shown in FIG. 1, a head unit 92 having an ink cartridge 91 is detachably mounted on a carriage 93. A driver IC substrate 94 on which a driving circuit 60 (see FIG. 2 is mounted is attached to the bottom portion of the head unit 92. The driver IC substrate 94 is connected to a power source circuit 40 and a control circuit 70 shown in FIG. 2 via a dimple flexible print circuit (FPC) 95 mounted on the upper surface of the carriage 93. As shown in FIG. 3, clock signal (CLK) 62, data signal (DATA) 63, strobe signal (STB) 65 and drive signal 100 are output to the driving circuit 60 from the control circuit 70.

A drive current V1 (see FIG. 3) flows in a drive power source line 74 connecting the power source circuit 40 and the driving circuit 60 shown in FIG. 2. The drive current V1 has an acute peak caused by rising, i.e., transition time, of the driving signal 100 output from the control circuit 70. Due to the acutely peaked drive current V1, the voltage of the power source circuit 40 instantaneously drops by virtue of the resistive component of the dimple FPC 95. The voltage drop of the power source circuit 40 does not sufficiently deform the piezoelectric element, resulting in weak ejection of the ink droplets.

In order to decrease the voltage drop, it has been proposed to connect a smoothing capacitor (or bypass capacitor) 76 between the drive power source line 74 in the vicinity of the driving circuit 60 and a ground line 75 as shown in FIG. 2. When replacement or repair of the head unit 92 are necessary due to malfunction, the power supply from the power source circuit 40 is interrupted and thereafter replacement of the head unit 92 is performed.

However, even if the power supply from the power source circuit 40 is interrupted, electric charges stored in the smoothing capacitor 76 cause a latchup current when a contact in a control system is opened while maintaining a high voltage contact in a closed condition. The latchup current may damage the driving circuit 60.

SUMMARY OF THE INVENTION

In view of the foregoing, it is an object of the present invention to provide an ink jet printer allowing a head unit to be easily exchanged without damaging a drive circuit mounted on the head unit.

It is another object of the invention to provide an ink jet printer in which an operator can detach a head unit upon confirming the end of discharge of a smoothing capacitor. To this end, the ink jet printer of the present invention is provided with an alarming means for alerting the operator of the end of discharge of the smoothing capacitor.

To achieve the above and other objects, there is provided an ink jet printer that includes an ink jet head for ejecting ink droplets toward a recording medium; a drive circuit supplied with a drive current for driving the ink jet head; head mounting means for detachably mounting the ink jet head; a smoothing capacitor for smoothing the drive current supplied to the drive circuit, the smoothing capacitor providing an output voltage when the drive current flows therethrough; detection means for detecting whether the output voltage of the smoothing capacitor is below a reference value, the detection means providing a detection output; and alarming mean for indicating the detection output.

The ink jet printer may further include a discharge circuit for discharging electrical charges stored in the smoothing capacitor.

The alarming means may be light emitting means for emitting light to indicate the detection output or sound generating means for generating sound to indicate the detection output.

The ink jet printer may further includes a carriage on which the head unit is mounted, and head unit moving means for moving the carriage to an exchange position where the head unit can be replaced with a new one. The alarm means indicates that the output voltage of the smoothing capacitor is below the reference value when the head unit moving means moves the carriage to the exchange position.

In accordance with another aspect of the invention, there is provided an ink jet printer that includes: an ink jet head for ejecting ink droplets toward a recording medium; a drive circuit supplied with a drive current for driving the ink jet head; head mounting means for detachably mounting the ink jet head; a power source circuit for supplying power to the drive circuit; and disconnection means for disconnecting the drive circuit from the power source circuit.

The drive circuit and the power source circuit have electrical contacts for mutual connection. The disconnection means disconnects electrical contacts of the drive circuit and the power source circuit.

The disconnection means includes a lock mechanism for looking the head unit and the head mounting means. The electrical contacts of the drive circuit and the power source circuit are separated from each other in accordance with an unlocking operation of the lock mechanism.

In one example, the lock mechanism includes: a first lock member formed to the head mounting means; a second lock member formed to the head unit to be engageable with the first lock member; a contact/separation member to be movable in accordance with the first lock member or the second lock member. When the first lock member and the second lock member are in an engagement with each other, the electrical contacts are in contact with each other whereas when the first lock member and the second lock member are disengaged from each other, one of the electrical contacts is separated the remaining one of the electrical contacts.

The electrical contacts of the drive circuit and the power source circuit are provided in a boundary between the head unit and the head mounting means.

The ink jet head may be made of a piezoelectric element, and walls defining an ink chamber filled with ink. The ink chamber is deformed to pressurize the ink when the piezoelectric element is applied with the drive voltage. Ink droplets are ejected from a nozzle formed in one of the walls.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

A preferred embodiment of the present invention will be described while referring to the accompanying drawings. In the following description, the expressions "front", "rear", "upper", "lower", "left" and "right" are used throughout the description to define the various parts when the printer is disposed in an orientation in which it is intended to be used.

Figure 1:
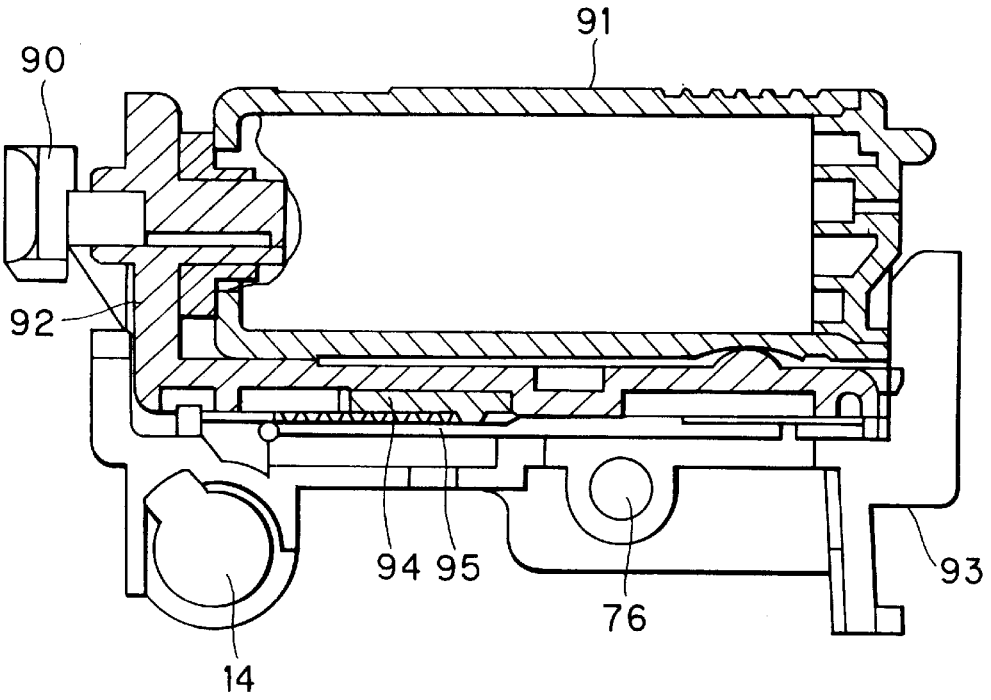
FIG. 1 PRIOR ART
FIG. 1 is a cross-sectional view showing a part of the periphery in a conventional head.
Figure 2:
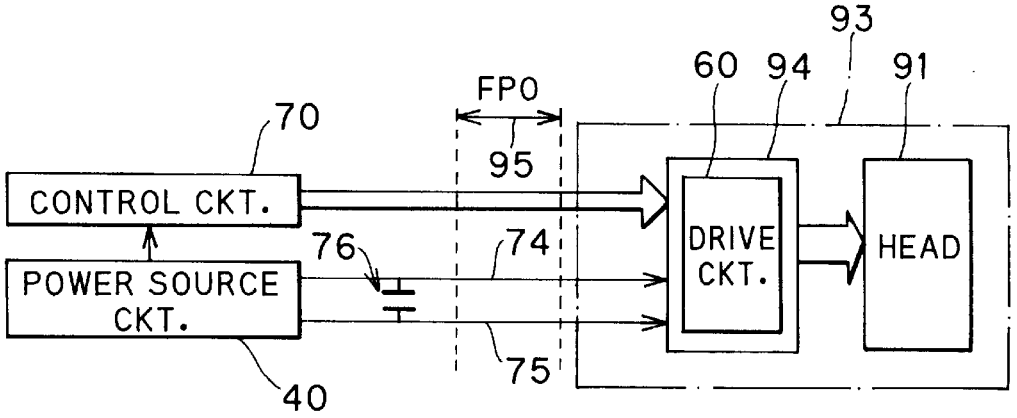
FIG. 2 PRIOR ART
FIG. 2 is a block diagram showing a conventional driving system.
Figure 3:
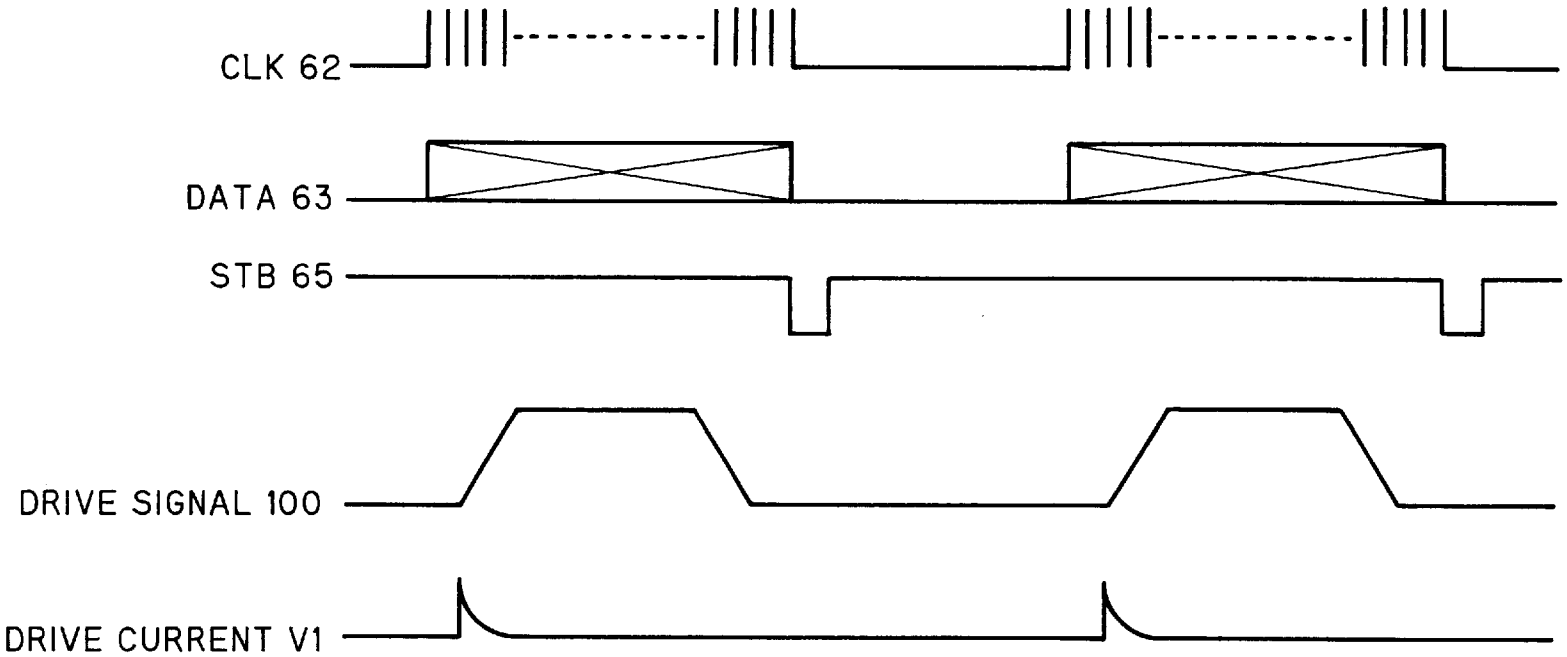
FIG. 3 PRIOR ART
FIG. 3 is a timing chart of signals output from a control circuit and a power source circuit to a drive circuit.
Figure 4:
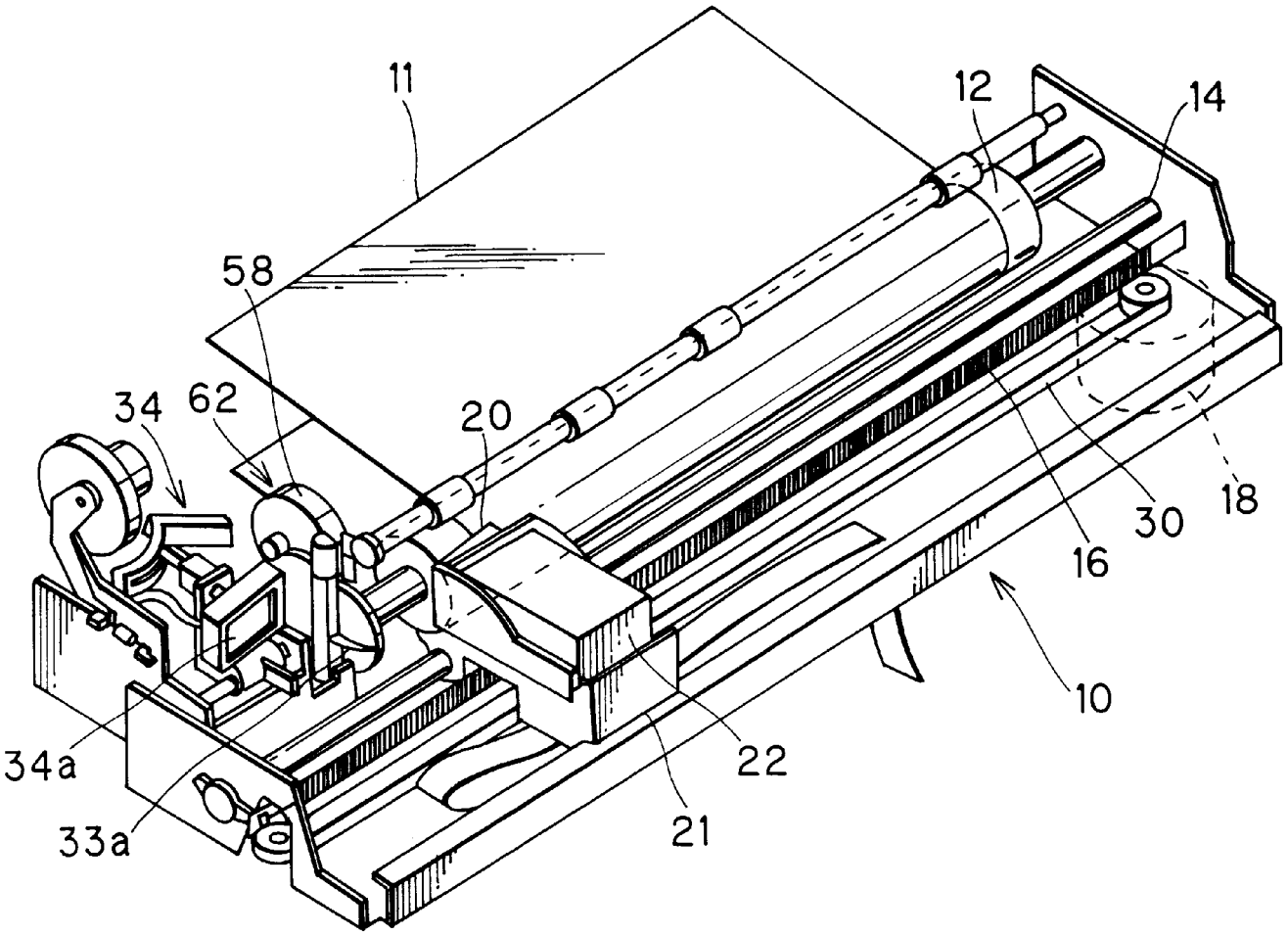
FIG. 4 is a perspective view showing a printer according to embodiments of the present invention.
Figure 5:
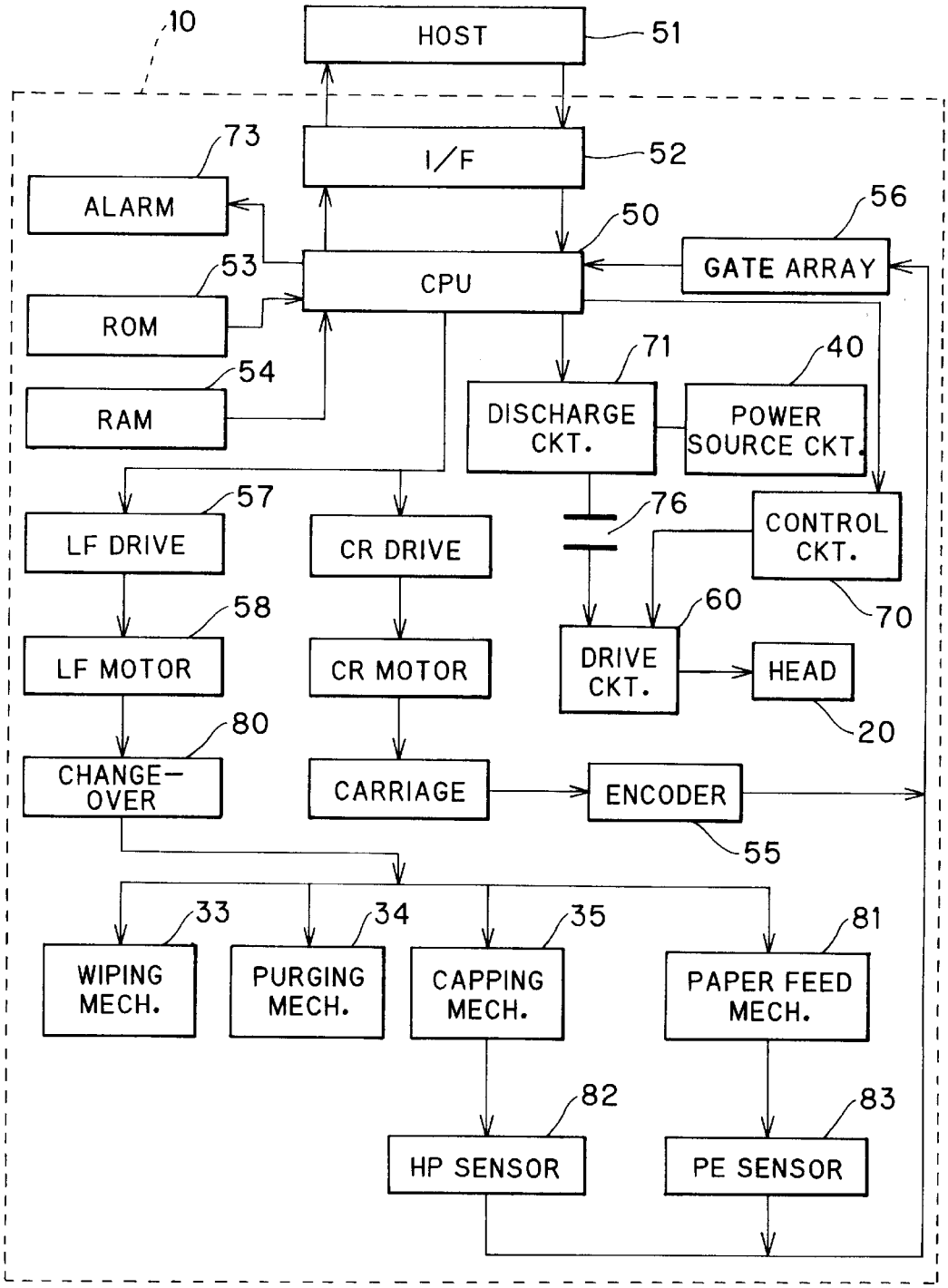
FIG. 5 is a block diagram showing a control system of the printer shown in FIG. 4.

FIG. 4 shows a printer according to the embodiment of the present invention. FIG. 5 is a block diagram of a control system of the printer shown in FIG. 4. The following description is directed to a color printer of the type using piezoelectric elements which pressurize ink contained in ink chambers to thereby elect ink droplets from nozzles. This, of course, should be understood as merely illustrative of the printer to which the invention is applicable, and not in any way limiting.

An overall structure of the printer will firstly be described. As shown in FIG. 4, the printer 10 is provided with a platen 12 for supporting a print paper 11. The platen 12 is rotatable about its longitudinal axis by virtue of a sheet feed mechanism 81 (see FIG. 5) that is operatively connected to an LF motor 58. A print head 20 is mounted on a carriage 21 and is movably disposed in front of the platen 12. A guide rod 14 is located in front lower position of the platen 12 and supported between side frames to extend in parallel to the platen 12. The carriage 21 is slidably movably supported on the guide rod 14.

The carriage 21 is connected to an endless belt 30 which is wound around the pulley of a CR (carriage) motor 18 and is moved thereby. With such a structure, the print head 20 reciprocates with forward and backward movements along the guide rod 14 while confronting the platen 12. A stepping motor is used for the LF motor 58, and a DC motor for the CR motor 18. The DC motor is subjected to a PWM (pulse width modulation) to control its rotational speed.

The print head 20 includes, although not shown in the drawings, a black ink head for ejecting black ink droplets, a yellow ink head for ejecting yellow ink droplets, cyan ink head for ejecting cyan ink droplets, and magenta ink head for ejecting magenta ink droplets. The head 20 further includes four ink cartridges 22 separately containing black, yellow, cyan and magenta inks. The ink cartridges 22 are detachably mounted on the carriage 21.

A plurality of ink chambers (not shown) are formed in the interior of the head 20. Ink is supplied from the ink cartridge and filled in the associated ink chamber (not shown). Each of the ink chambers has a nozzle formed surface confronting the platen 12. Each ink chamber has piezoelectric elements which when applied with a driving voltage, deform to change the volume of the ink chamber. When the ink is pressurized by the deformation of the ink chamber, an ink droplet is ejected from the nozzle toward the print paper 11.

A linear timing slit 16 formed with vertically extending slits is provided along and below the guide rod 14. A sensor element (not shown) is disposed in the front lower portion of the carriage 21, which senses the slits on the timing slit 16. The timing slit 16 and the sensor element constitute an encoder 55.

The printer 10 is provided with a flashing mechanism for causing bubble-containing ink to eject toward an ink absorbing material (not shown) at a regular time interval so that a desirable printing condition can be maintained. The printer 10 is also provided with a purging mechanism 34 which sucks dried ink or foreign materials clogged in the nozzles at a regular time interval to maintain a desirable ink ejection condition. In the left side of the head's moving direction, a suction cap 34*a* is provided for capping the head which performs purging.

The printer 10 is further provided with a capping mechanism 35 (see FIG. 5) which covers, using a suction cap 34*a*, the nozzle-formed surface of the print head 20 when the head 20 is not used for more than a predetermined period of time. The printer 10 is also provided with a wiping mechanism 33 (see FIG. 5) for wiping off and cleaning the ink remaining on the nozzle-formed surface of the head 20. A wiping member 33*a* is provided rightwardly of the suction cap 34*a* as shown in FIG. 4.

Next, primary components of a printer control system will be described with reference to FIG. 5. The printer 10 includes a central processing unit (CPU) 50 for implementing various processes. To the CPU 50 are connected a discharge circuit 71, an alarm circuit 73, an interface 52, and a control circuit 70. The discharge circuit 71 discharges a smoothing capacitor 76 connected to a driving circuit 60 for driving the head 20. The alarm circuit 73 alerts that the discharge of the smoothing capacitor 76 has taken place. The interface 52 is provided for receiving print data and other types of data output from a host computer 51. The control circuit 70 controls the driving circuit 60. A read-only memory (ROM) 53, a random access memory (RAM) 54, and a gate array 56 are also connected to the CPU 50. The ROM 53 stores various programs including a print program for printing while driving the head 20. The gate array 56 receives an encoder signal output from the encoder 55 and computes the location of the carriage 21 based thereon.

The CPU 50 receives print data from the host computer 51 through the interface 52 and stores the same in predetermined storage locations of the RAM 54. The CPU 50 outputs various control signals for driving the LF motor 58, CR motor 18 and the head 20 in accordance with a print program stored in the ROM 53. The control signals include an LF motor drive control signal that is input to an LF drive circuit 57 which in turn outputs an LF motor drive signal for driving the LF motor 53. Rotations of the LF motor 58 transport the print paper 11.

The wiping mechanism 33, purging mechanism 34 and the capping mechanism 35 are driven by the LF motor 58 through a change-over mechanism 80. The control signals further include a CR motor drive control signal that is input to a CR drive circuit 59 which in turn outputs a CR motor drive signal for driving the CR motor 18. Rotations of the CR motor 18 reciprocate the carriage 21. The position of the carriage 21 is detected by the encoder 55.

The encoder signal output from the encoder 55 is applied to the gate array 56 and the latter generates a speed data signal of the carriage 21, position control pulses (reference pulses) of the carriage 21, and print timing pulses for driving the head 20 based on the encoder signal.

The CPU 50 receives speed data from the gate array 56 and performs computations of a PWM signal. The speed data is a time span value between edges of the encoder signal. The PWM signal is a pulse width of the drive signal for the CR motor 18. The CPU 50 further receives the position control pulses (reference pulses) and performs computations of the current position of the carriage 21. The CPU 50 writes data in the register of the gate array 56. The data written therein includes a delay count value for adjusting a print position when printing direction is reversed, and data for outputting a print start signal.

The CPU 50 counts the number of pulses of the drive signals for driving the LF motor 58 to detect an amount of print paper fed by the LF motor 58 and the paper feed mechanism 81. The CPU 50 also detects a rotational angle of a cam which drives the purging mechanism 34 or the capping mechanism 35. A home position (HP) sensor 82 is provided in the capping mechanism 35 for detecting that the carriage 21 has returned to a capping position (home position). A paper empty (PE) sensor 83 is provided in the paper feed mechanism 81 for detecting insertion and discharge of a print paper.

Figure 6:
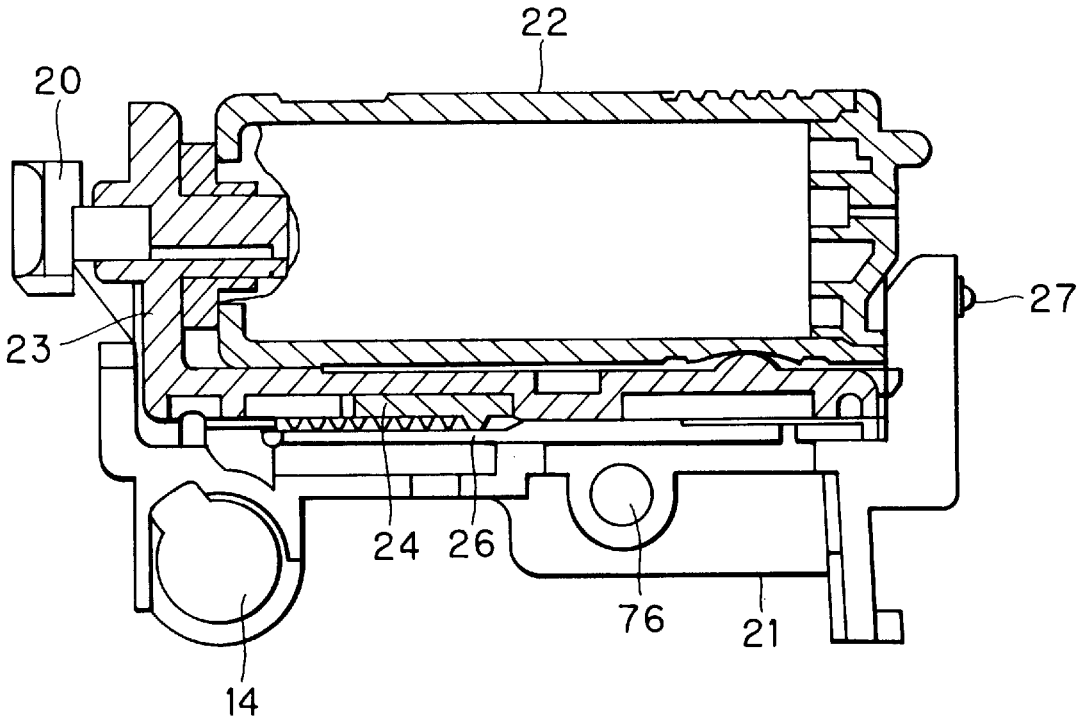
FIG. 6 is a cross-sectional view showing a part of the periphery of a head in the printer shown in FIG. 4.

A structure for discharging the smoothing capacitor 76 and alerting that the smoothing capacitor 76 has been discharged will be described with reference to FIGS. 6 through 13. The smoothing capacitor 76 is provided for smoothing the drive current applied to the head 20. First, an electrical connection between a head unit 23 and the carriage 21 will be described. FIG. 6 is a cross-sectional diagram showing a part of periphery of the head 20.

Figure 7:
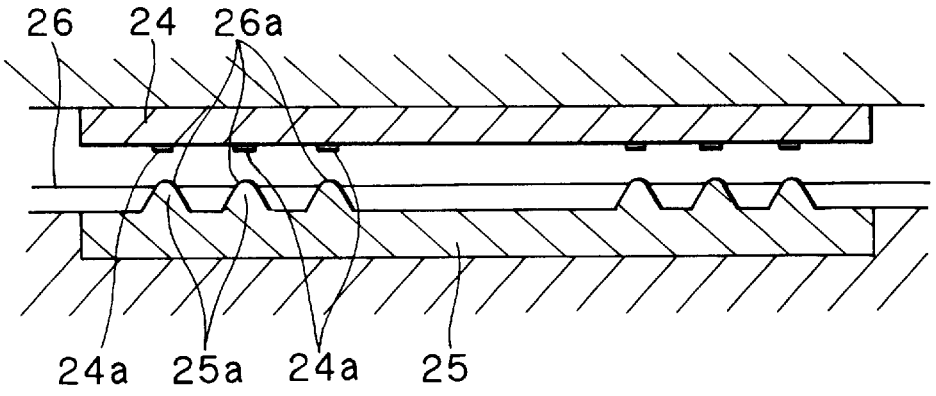
FIG. 7 is a cross-sectional view showing a connecting portion between a driver IC substrate and a dimple FPC.
Figure 8:
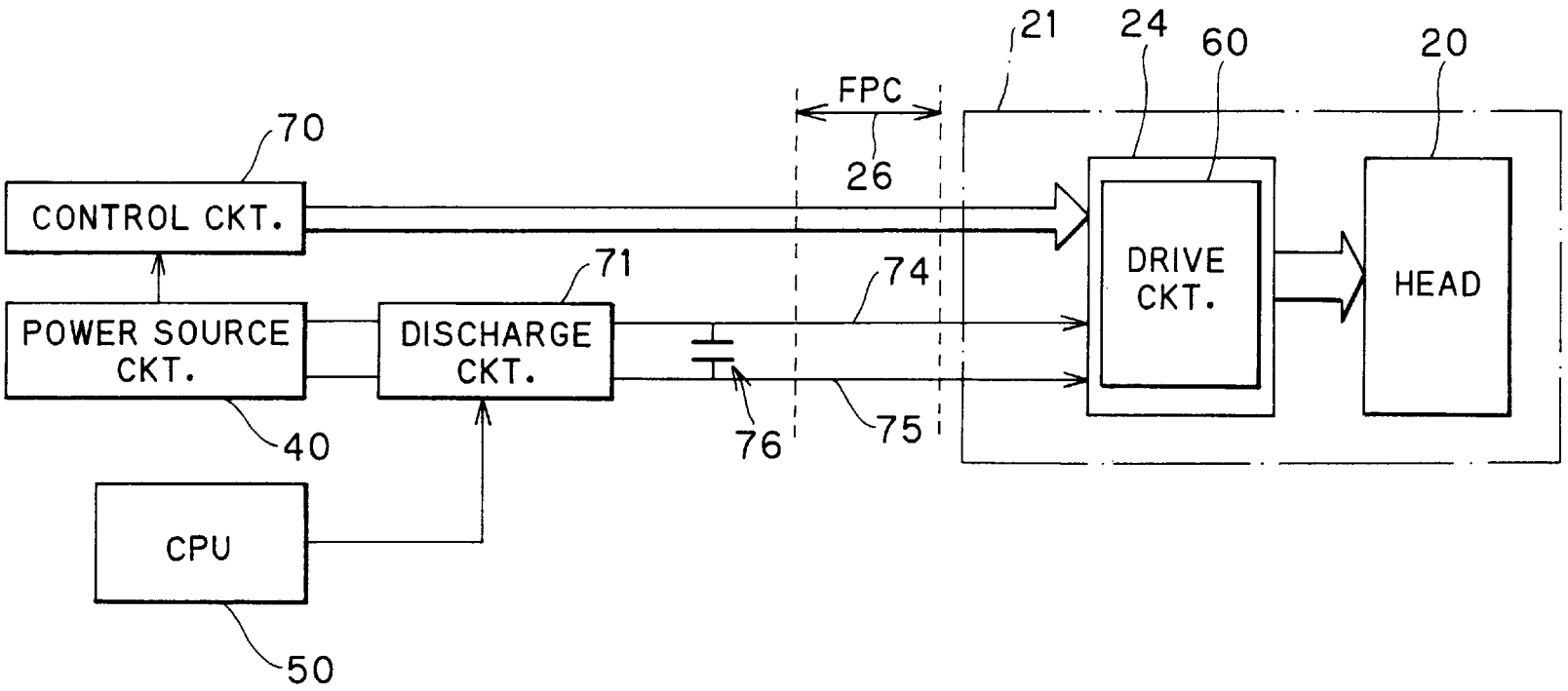
FIG. 8 is a block diagram showing a location of a discharge circuit.

As shown in FIG. 6, a driver IC substrate 24 on which the drive circuit 60 is mounted is provided in the lower portion of the head unit 23 which includes the head 20. A dimple FPC 26 is mounted on the carriage 21, which is electrically connected to the driver IC substrate 24. As shown in FIG. 8, the dimple FPC 26 serves as a contact point for connecting the control circuit 70 and the power source circuit 40 to the drive circuit 60 mounted on the driver IC substrate 24. Specifically, the various signals output from the control circuit 70 are output to the drive circuit 60 and the drive signal output from the power source circuit 40 is applied to the drive circuit 60 through a drive power source line 74 and ground line 75. FIG. 7 shows an enlarged diagram showing contact portions between the driver IC substrate 24 and the dimple FPC 26. As shown therein, the lower surface of the driver IC substrate 24 is formed with a plurality of contacts 24*a* that lead to the drive circuit 60. The upper portion of the dimple FPC 26 is formed with a plurality of protruding contacts 26*a* which are brought into contact with the respective contacts 24*a*.

A backup rubber 25 is attached to the lower surface of the dimple FPC 25. The backup rubber 25 has a plurality of protruding portions 26*a* to mate with concave portions formed in the rear surface of the dimple FPC 26 corresponding to the contacts 26*a*. Resiliency of the backup rubber 25 maintains the electrical contacts between the contacts 26*a* of the dimple FPC 26 and the driver IC substrate 24. The head unit 23 is detachably mounted on the carriage 21 by means of a lock mechanism to be described later.

The drive voltage V1 is applied from the power source circuit 40 to the driver IC substrate 24 through the drive power source line 74 and the ground line 75, and the dimple FPC 26. The smoothing capacitor 76 is connected between the drive power line 74 and the ground line 75 to prevent a voltage drop when the drive current flows in the driver IC substrate 24. As shown in FIG. 6, a light emitting diode (LED) 27 is provided in the carriage 21 for alerting that the smoothing capacitor 76 has been discharged.

Next, referring to FIGS. 8 and 9, a discharge circuit for discharging the smoothing capacitor 76 will be described. As shown in FIG. 8, the discharge circuit 71 is connected between the power source circuit 40 and the driver IC substrate 24 via the dimple FPC 25. The discharge circuit 71 is also connected to the CPU 50.

Figure 9:
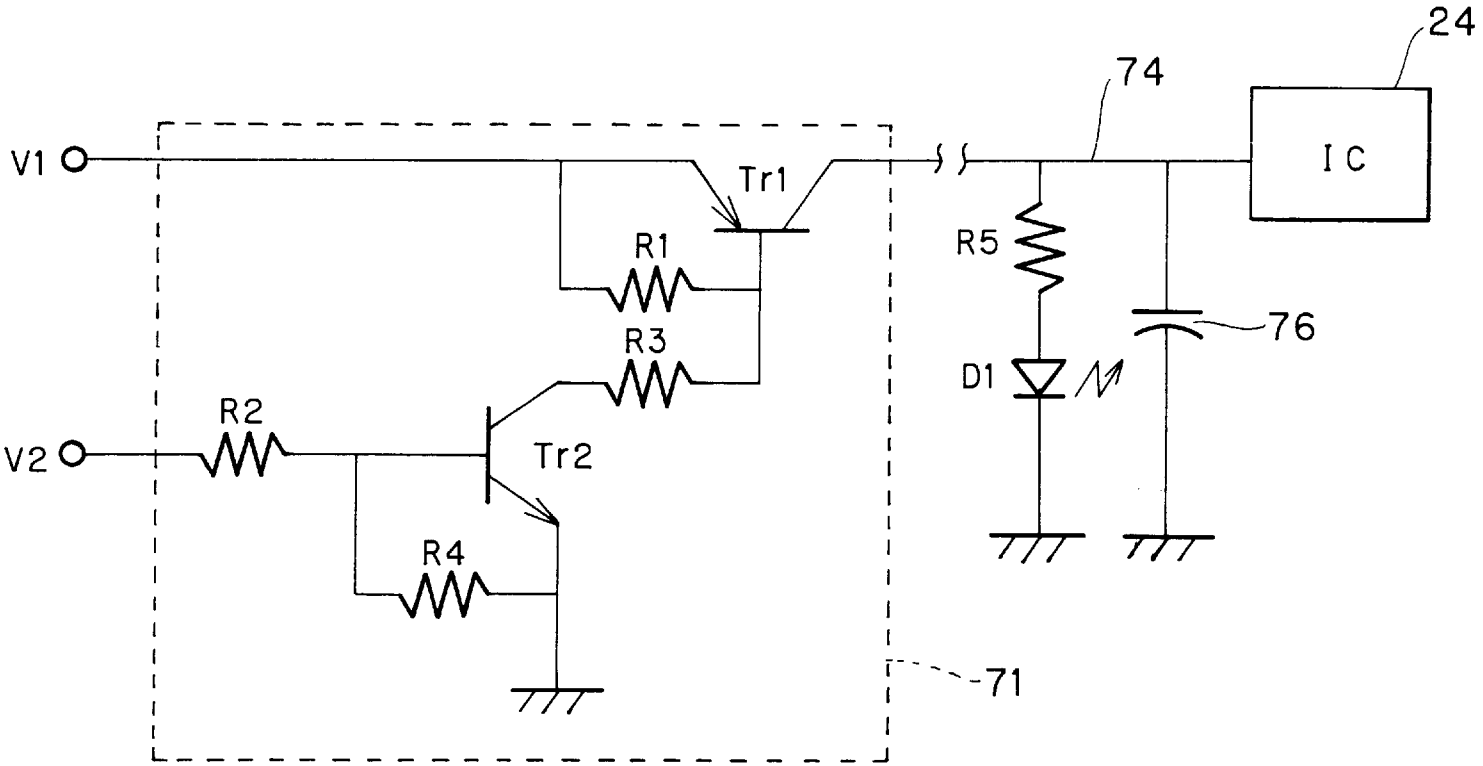
FIG. 9 is a circuit diagram showing a configuration of the discharge circuit according to one example of the invention.

FIG. 9 shows a circuit configuration showing the discharge circuit 71. When the hear 20 is being driven, the drive voltage V1 and the power source cutoff signal V2 are at a high level. Therefore, both the transistors Tr1 and Tr2 are rendered conductive, so that the drive voltage V1 is applied to the driver IC substrate 24 via the transistor Tr1. When an instruction to exchange the head unit 23 is issued to the printer 10, then the power source cutoff signal V2 that is output from the CPU 50 to the discharge circuit 71 is changed to a low level. This renders the transistor Tr2 non-conductive and accordingly the transistor Tr1 is also rendered non-conductive.

The electric charges stored in the smoothing capacitor 76 are dissipated in the resistor R5 and a light emitting diode D1 connected between the resistor R5 and the smoothing capacitor 76 turns off, thereby alerting that the smoothing capacitor 76 has been discharged. Therefore, the drive circuit 60 mounted on the driver IC substrate 24 can be prevented from being damaged by the electrical charges stored in the smoothing capacitor provided that exchange of the head unit 23 is performed upon confirming that the LED D1 has turned off. A liquid crystal display (LCD) panel on the printer 10 may be controlled to display some characters to indicate that the head unit 23 is ready to exchange.

Figure 10:
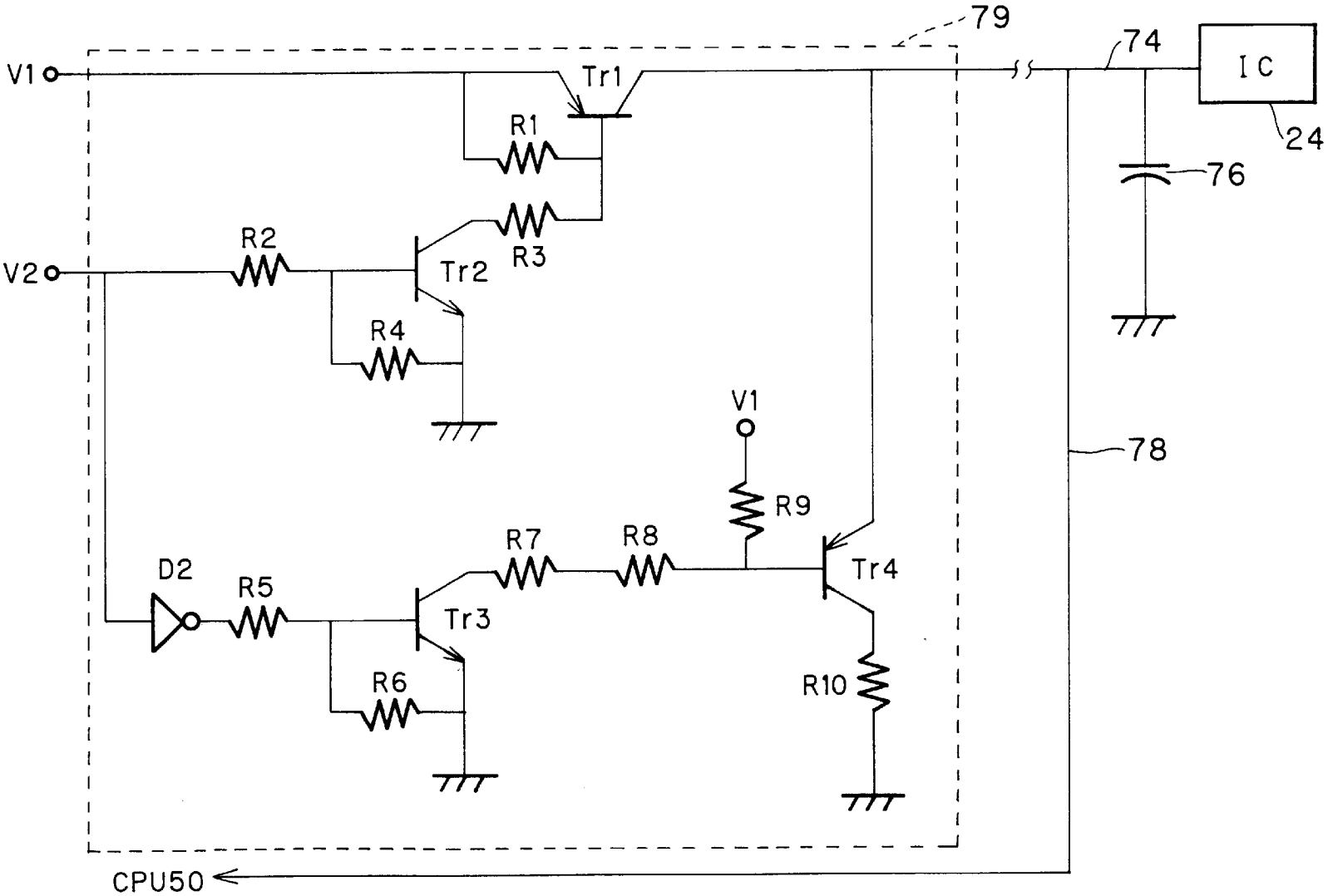
FIG. 10 is a circuit diagram showing a configuration of the discharge circuit according to another example of the invention.

Another example of the discharge circuit will be described with reference to FIG. 10. The discharge circuit in this example operates based on the fact that the drive voltage applied to the driver IC substrate 24 from the smoothing capacitor 76 is less than a reference voltage. As shown in FIG. 10, the drive power source line 74 connecting the discharge circuit 79 and the driver IC substrate 24 is connected to the CPU 50 by a detection line 78, allowing the CPU 50 to detect the output voltage of the smoothing capacitor 76 at its A/D port.

Figure 11:
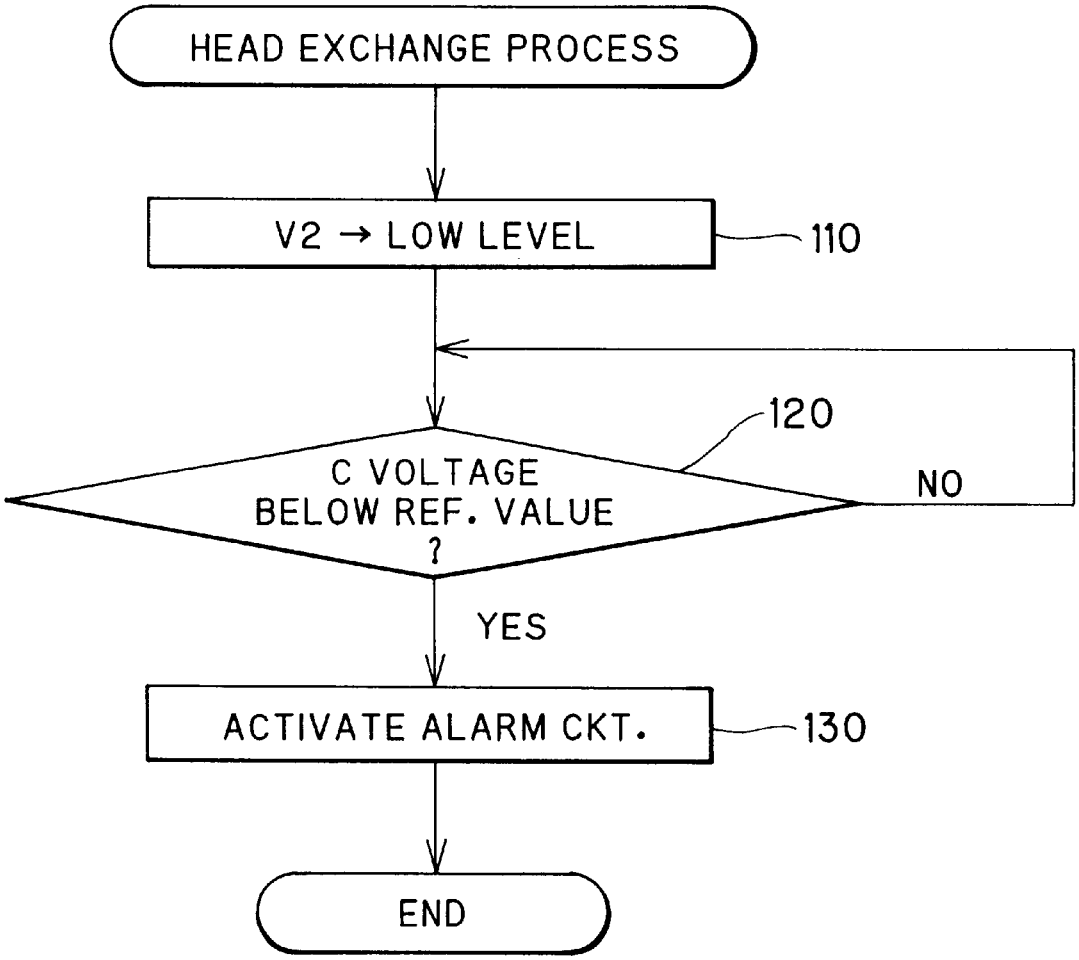
FIG. 11 is a flowchart illustrating a head exchange process according to one example of the invention.

Control of the discharge circuit 79 by the CPU 50 will be described with reference to the flowcharts shown in FIGS. 11 through 13.

When an operator informs the printer 10 of an exchange of the head unit through a panel unit (not shown), the CPU 50 changes the power source cutoff signal V2 from high level to low level (step 110). A transistor Tr2 is rendered non-conductive and so a transistor Tr1 is rendered non-conductive, with the result that the power source voltage V1 supplied from the power source circuit 40 is not applied to the driver IC substrate 24. in this condition, a transistor Tr3 is rendered conductive because the low level of the power source cutoff signal V2 is inverted by virtue of an inverter D2. A transistor Tr4 is also rendered conductive. Electric charges stored in the smoothing capacitor 76 are therefore dissipated in a resistor R10 connected to the collector of the transistor Tr4.

The voltage across the smoothing capacitor 76 has been monitored by the CPU 50 and the latter determines that the voltage thereacross falls below the reference value. In other words, the CPU 50 determines whether or not electrical charges stored in the smoothing capacitor 76 have been reduced to a level that will not damage the drive circuit 60 (step 120). When the voltage across the smoothing capacitor 76 falls below the reference value, the CPU 50 outputs a command to the alarm circuit 73 (see FIG. 5) to alert that the head unit 23 is now exchangeable. This is done by turning off the LED or by indicating a relevant message in the LCD.

Figure 12:
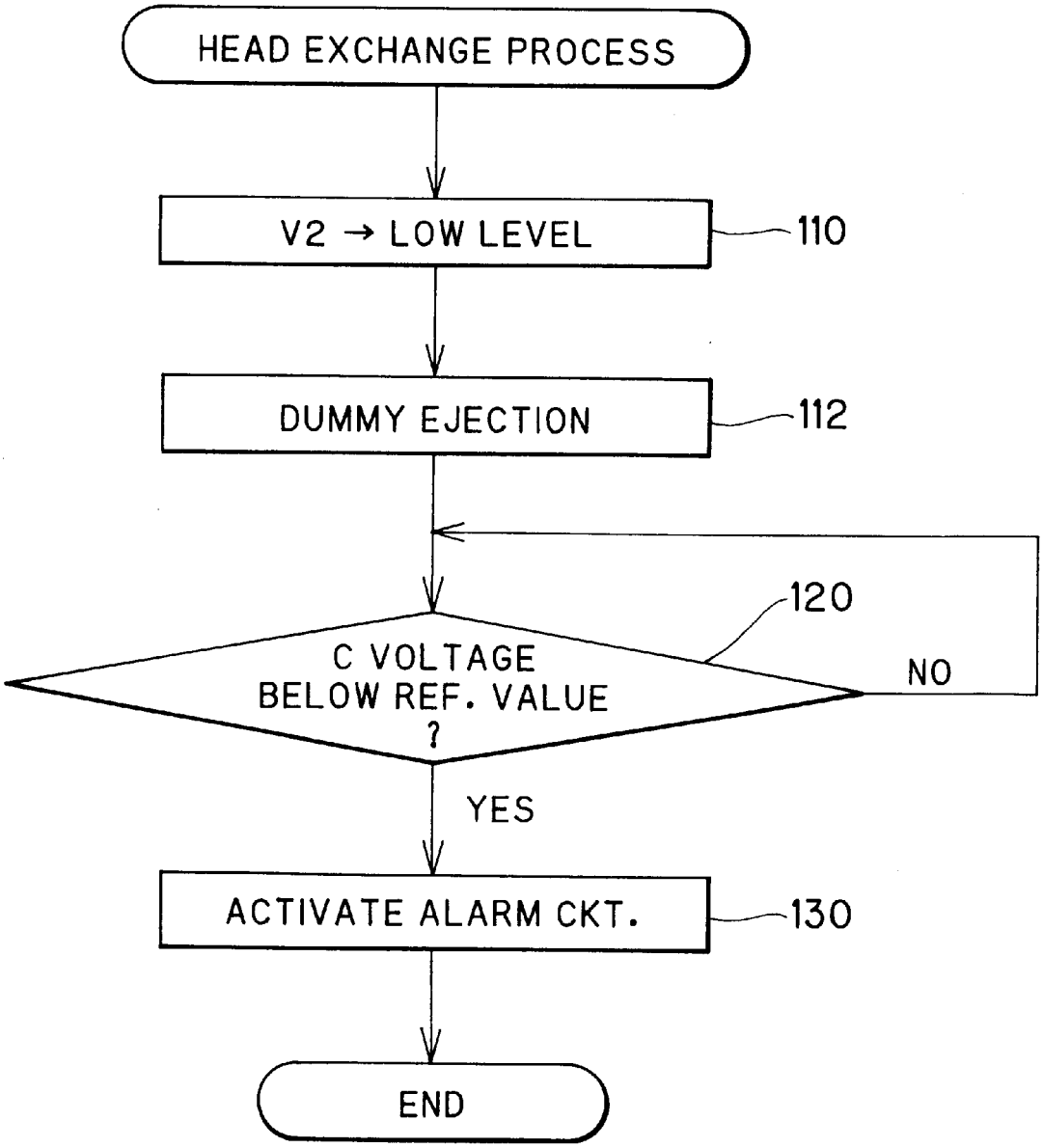
FIG. 12 is a flowchart illustrating a head exchange process according to another example of the invention.
Figure 13:
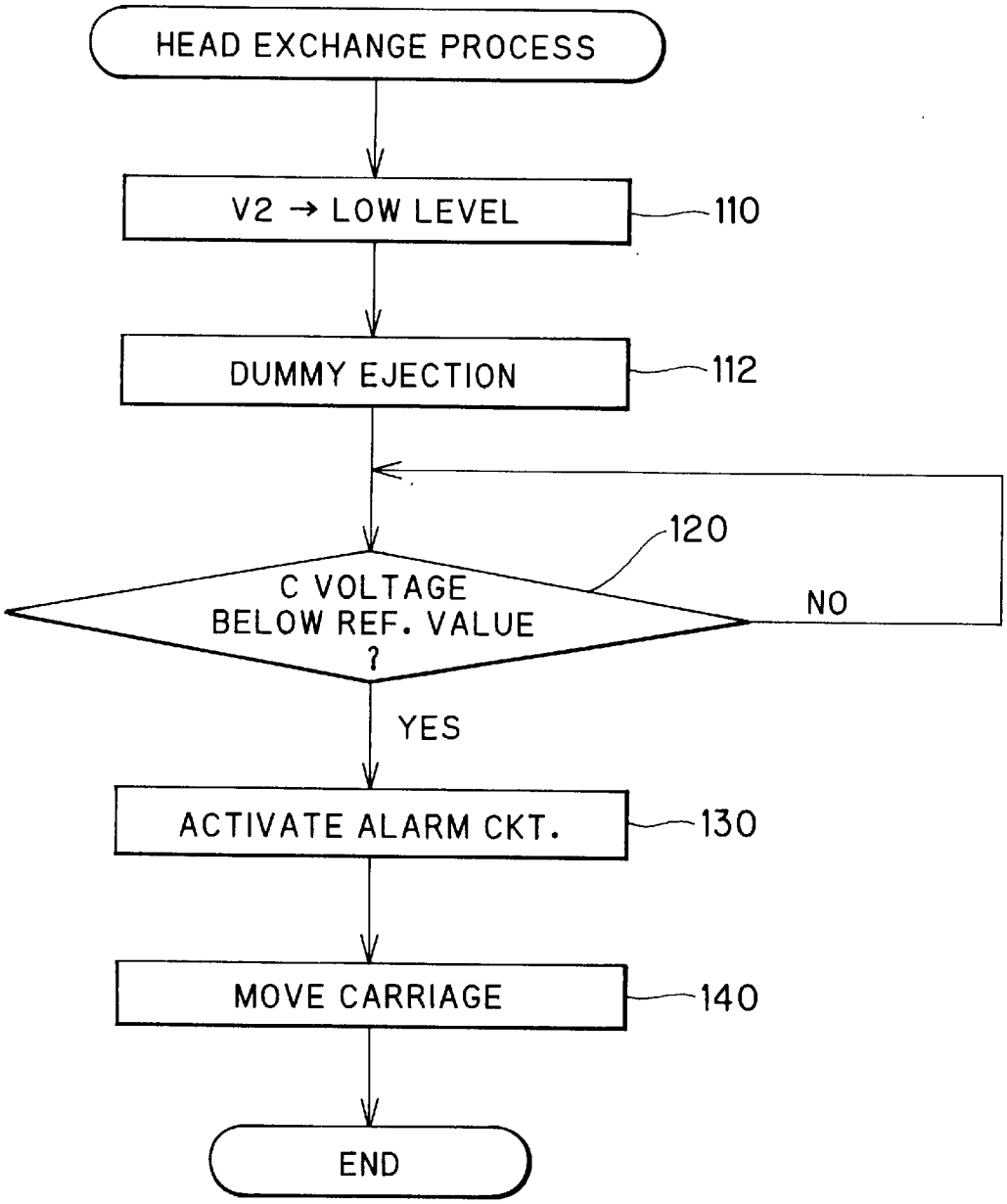
FIG. 13 is a flowchart illustrating a head exchange process according to still another example of the invention.

As shown in the flowchart of FIG. 12, after the power source cutoff signal V2 is changed from high level to low level, step 112 may be provided in which a dummy ejection operation, such as flashing operation, may be executed. The dummy ejection operation dissipates the electrical charges stored in the smoothing capacitor 76. In such a case, a discharging resistor is not required.

There may be cases where the user inadvertently detaches the head unit before permission to do so is given. To prevent such an occurrence, the mounting structure of the head unit 23 may be made so that the head unit 23 can only be detached in a designated position of the printer 10. With such a structure, as shown in FIG. 12, the carriage 21 may be forcibly moved to the designated position (step 140) after the alarm circuit is activated (step 130) to prevent the head unit 23 from being inadvertently detached from the printer 10. This modification perfectly prevents the damage of the drive circuit 60.

Figure 15:
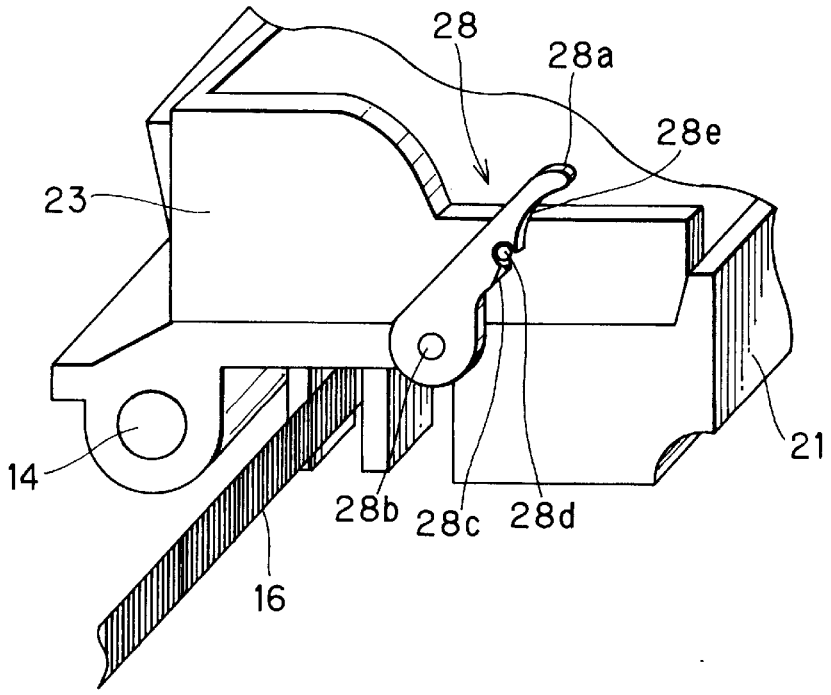
FIG. 15. is a perspective view showing a head unit mounted on a carriage 21.
Figure 16:
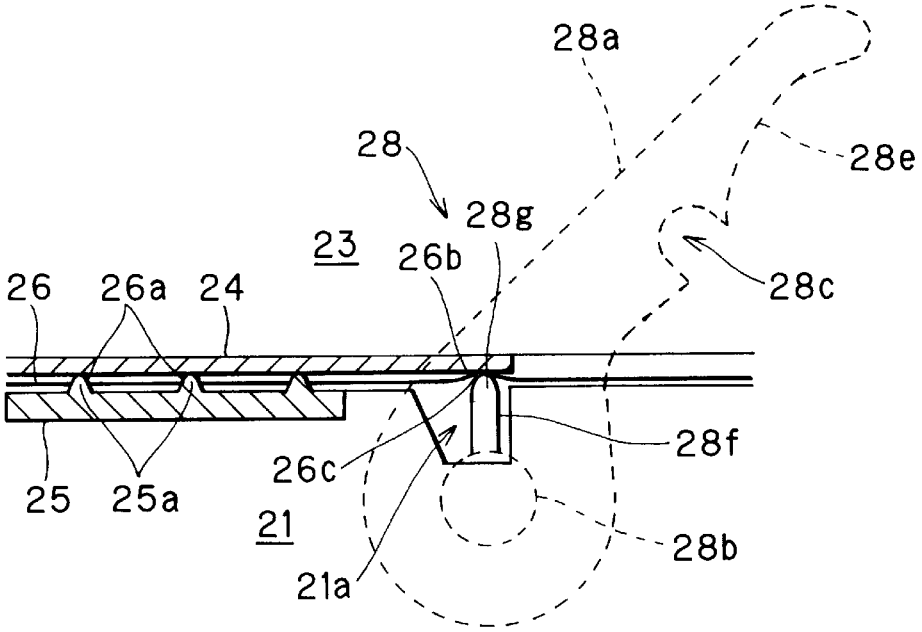
FIG. 16 is a cross-sectional view showing a locked condition of the head unit and the carriage.
Figure 17:
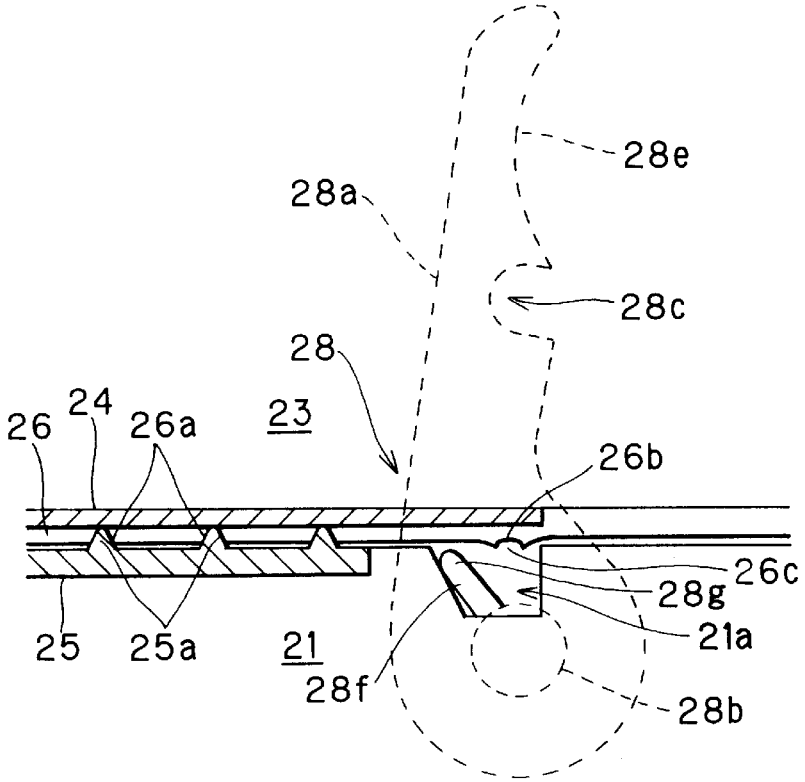
FIG. 17 is a cross-sectional view showing an unlocked condition of the head unit and the carriage.

A structure to mount the head unit 23 on the carriage 21 will be described with reference to FIGS. 15 through 17 FIG. 15 shows how the head unit 23 is fixedly mounted on the carriage 21. FIG. 16 shows a locked condition of the head unit 23 and the carriage 21, and FIG. 17 shows an unlocked condition of these two. As shown in FIG. 15, a lever 28*a* serving as a first locking member is attached to the left side surface of the carriage 21 so as to be rotatable about an attachment shaft 28*b*. A cutaway portion 28*c* is formed in the center portion of the lever 28*a*. The cutaway portion 28*c* engages a projection 28*d* formed on the left side surface of the head unit 23. The projection 28*d* serves as a second locking member. The free end of the lever 28 has a smoothly curved surface for the sake of user's manipulation. The lever 28*a* and the projection 28*d* form a lock mechanism 28 with which the head unit 23 is fixedly mounted on the carriage 21.

As shown in FIG. 16, the driver IC substrate 24 on which the drive circuit is mounted is attached to the bottom surface of the head unit 23 as described previously. The dimple FPC 26 is placed on the upper surface of the carriage 21 for connection of the driver IC substrate 24 to the power source circuit 40 and the control circuit 70. The dimple FPC 26 is formed with a plurality of contacts 26*a* and 26*b* for connection between the driver IC substrate 24 and the dimple FPC 26. The contacts 26*a* are for connection to the control circuit 70, and the contacts 26*b* to the drive power source line 74.

The attachment shaft 28*b* of the lever 28*a* is located in the right lower portion of the driver IC substrate 24 and the dimple FPC 26. A pin 28*f* is integrally formed on the upper peripheral portion of the attachment shaft 28*b*. The pin 28*f* extends in a radial direction of the attachment shaft 28*b* and is located inside the lever 28*a*. As shown in FIGS. 16 and 17, the pin 28*f* rotates within a concave groove 21*a* formed in the carriage in accordance with rotations of the attachment shaft 28*b*.

Figure 14:
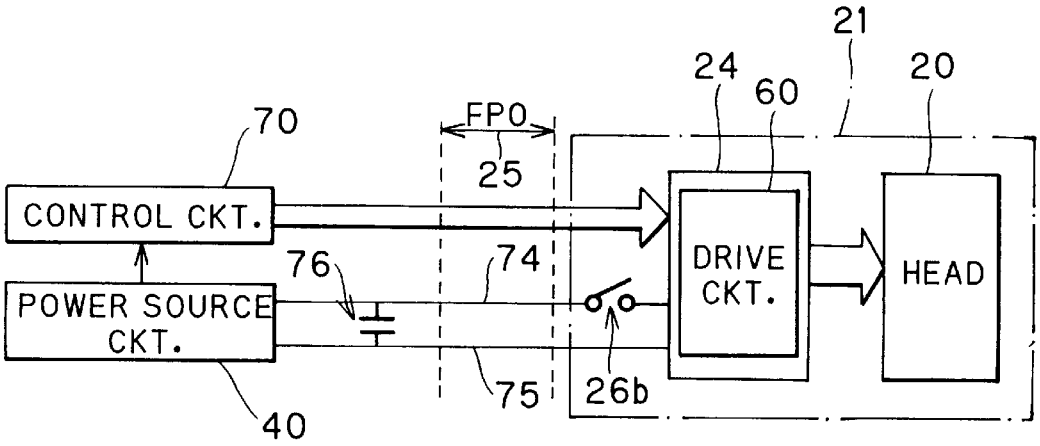
FIG. 14 is a block diagram showing connections or a control circuit and a power source circuit to a driver IC substrate.

As shown in FIG. 16, the high voltage contact 26*b* connected to the drive power source line 74 (see FIG. 14) is formed in the dimple FPC 26. The contact 26*b* is in a concave shape to receive the tip end 28*g* of the pin 28*f* as shown in FIG. 16. When the head unit 23 and the carriage 21 are locked by means of the lock mechanism 28, the tip end 28*g* of the pin 28*f* is fitted into the concave portion 26*c* and upwardly urges the contact 26*b*, causing electrical connection between the contact point 26*b* and the driver IC substrate 24 to maintain.

When the lever 28*a* is rotated in counter-clockwise direction from the locked condition shown in FIG. 16, the pin 28*f* is also rotated in the same direction, thereby disengaging the tip end 28*g* of the pin 28*f* from the concave portion 26*c* formed in the dimple FPC 26. The contact 26*b* restores downwardly due to the restoring force of the dimple FPC 26, thereby disconnecting the contact 26*b* from the driver IC substrate 24. Consequently, connection of the drive power source line 74 is disabled while maintaining the contact with the control circuit 70 with the contact 26*a*. Specifically, a power supply to the drive circuit 60 can be interrupted and therefore damage of the drive circuit due to latchup current can be effectively prevented. A display may be provided to alert the power supply interruption.

The projection 28*d* disengages from the cutaway portion 28*c* formed in the lever 28*a* due to the rotations of the lever 28*a*, thereby allowing the head unit 23 to detach from the carriage 21. On the other hand, when the head unit 23 is mounted on the carriage 21, the lever 28 is rotated in clockwise direction so that the cutaway portion 28*c* is brought into engagement with the projection 28*d*, whereby the head unit 23 is locked to the carriage 21.

As described above, detaching the head unit from the carriage 21 is enabled after the high voltage electrical connection is cut. Therefore, the drive circuit 60 will not be damaged by the latchup current flowing in the high voltage line. Moreover, the head unit 23 can be readily detached from the carriage 21 by simply rotating the lever 28*a*.

While several exemplary embodiments of this invention have been described in detail, those skilled in the art will recognize that there are many possible modifications and variations which may be may in these exemplary embodiments while yet retaining many of the novel features and advantages of the invention. For example, in lieu of using visual means, such as LED or LCD, for alerting the completion of the discharge in the smoothing capacitor 76, audible means may be employed, for example, by a buzzer or an announcement saying "Head unit is ready for exchange".

Although the present Invention has been described with reference to a color ink jet printer employing piezoelectric elements, it can be applied to other types of printers that have a power supply contact between the head unit and the carriage.

What is claimed is:

1. An ink jet printer comprising:

an ink jet head unit that ejects ink droplets toward a recording medium;

a drive circuit that drives said ink jet head unit when supplied with a drive current;

a head mounting mechanism detachably mounting said ink jet head unit;

a smoothing capacitor for smoothing the drive current by providing an output voltage when the drive current flows therethrough;

a discharge circuit that discharges electrical charges stored in said smoothing capacitor to decrease the output voltage of said smoothing capacitor so as to prevent a latchup current from being generated;

a detection circuit that detects whether the output voltage of said smoothing capacitor falls below a reference value, said detection circuit providing a detection output; and an alarming unit that indicates the detection output.

2. The ink jet printer according to claim 1, wherein said alarming unit comprises a light emitting device emitting light to indicate the detection output.

3. The ink jet printer according to claim 1, wherein said alarming unit comprising a sound generating device generating sound to indicate the detection output.

4. The ink jet printer according to claim 1, further comprising a carriage on which said head unit is mounted, and a head unit moving mechanism that moves said carriage to an exchange position where said head unit can be replaced with a new one, and wherein said alarming unit indicates that the output voltage of said smoothing capacitor is below the reference value when said head unit moving mechanism moves said carriage to the exchange position.

5. The ink jet printer according to claim 1, wherein said ink jet head unit comprises a piezoelectric element, and walls defining an ink chamber filled with ink, said ink chamber being deformed to pressurize the ink when said piezoelectric element is applied with the drive voltage, ink droplets being ejected from a nozzle formed in one of said walls.

6. An ink jet printer comprising:

an ink jet head unit that ejects ink droplets toward a recording medium;

a drive circuit that drives said ink jet head when supplied with a drive current;

a control circuit that is connected to the drive circuit for controlling the drive circuit;

a head mounting mechanism detachably mounting said ink jet head;

a power source circuit that is electrically connected to said driver circuit for supplying power to said drive circuit; and a disconnection unit for disconnecting said drive circuit from said power source circuit while maintaining an electrical connection between said drive circuit and said control circuit.

7. The ink jet printer according to claim 6, wherein each of said drive circuit and said power source circuit has an electrical contact for mutual connection, and wherein said disconnection unit disconnects the electrical contacts of said drive circuit and said power source circuit.

8. The ink jet printer according to claim 7, wherein said disconnection unit comprises a lock mechanism that locks said head unit and said head mounting mechanism.

9. The ink jet printer according to claim 8, said lock mechanism comprises:

a first lock member formed on one of said head mounting mechanism and said head unit;

a second lock member formed on another one of said head mounting mechanism and said head unit; said second lock is movable to engage with and disengage from said first lock member;

a contact/separation member that integrally moves with said second lock member, wherein when said first lock member and said second lock member are in an engagement with each other, said contact/separation member contacts the electrical contacts in contact with each other whereas when said first lock member and said second lock member are disengaged from each other, said contact/separation member separates one of the electrical contacts from a remaining one of the electrical contacts.

10. The ink jet printer according to claim 9, wherein the electrical contacts of said drive circuit and said power source circuit are provided in a boundary between said head unit and said head mounting mechanism.

11. The ink jet printer according to claim 10, wherein said ink jet head unit comprises a piezoelectric element, and walls defining an ink chamber filled with ink, said ink chamber being deformed to pressurize the ink when said piezoelectric element is applied with the drive voltage, ink droplets being ejected from a nozzle formed in one of said walls.

12. An ink jet printer comprising:

a detachable print head unit that ejects ink;

a carriage assembly that detachably mounts the head unit;

a drive circuit supplied with a drive current that drives said head unit;

at least one first electrical contact connected to the drive circuit;

a power source that supplies power to said drive circuit;

at least one second electrical contact connected to the power source, wherein the first electrical contact is mutually connected to the second electrical contact;

a disconnection unit that selectively disconnects the mutually connected first and second electrical contacts, the disconnection unit further including:

a) a first locking member mounted to the print head unit;

b) a second locking member mounted to the carriage assembly and engageable by the first locking member;

c) an actuator mounted to a selected one of the locking members that urge the first and second contacts into mutual connection when the locking members are engaged, and disconnecting the first and second contacts when the locking members are disengaged.

13. The apparatus set forth in claim 12 wherein the first and second electrical contacts are located along a flexible interface located between the head unit and the carriage.

14. An ink jet printer comprising:

a print head assembly detachably mounted to a carriage;

a head driving circuit mounted to the head assembly and having a first electrical contact located thereon;

a power source located in spaced relation to the head assembly;

a flexible printed circuit having an input connected to a power source and an output connected to a second contact that is correspondingly aligned with the first contact of the driving circuit;

a lever rotatable to a first position for removably latching the head assembly to the carriage;

an actuator formed on the lever and rotatable therewith for selectively urging the first and second contacts into engagement when the actuator is in a locked first position, and disconnecting the associated first and second contacts when the lever is rotated to a second position thereby terminating energization of the drive circuit by the power source.

15. The apparatus set forth in claim 14 further comprising:

a capacitor connected between the power source and the driving circuit for smoothing voltage provided to the drive circuit from the power source;

a detector connected to the capacitor for detecting the occurrence of voltage across the capacitor below a preselected threshold; and an indicator connected to the detector for indicating the occurrence.

16. The apparatus set forth in claim 15 further comprising a discharge circuit connected to the capacitor for discharging charge stored in the capacitor in response to disconnection of the associated first and second contacts.

* * * * *